US007748057B2

(12) United States Patent
Boltan

(10) Patent No.: US 7,748,057 B2
(45) Date of Patent: Jul. 6, 2010

(54) THREE-DIMENSIONAL NECK TIES

(76) Inventor: Zinaida Boltan, 1508 Candlelight Cove, Flower Mound, TX (US) 75028

( * ) Notice: Subject to any disclaimer, the term of this patent is extended or adjusted under 35 U.S.C. 154(b) by 834 days.

(21) Appl. No.: 11/105,691

(22) Filed: Apr. 14, 2005

(65) Prior Publication Data

US 2006/0230492 A1 Oct. 19, 2006

(51) Int. Cl.
*A41D 25/00* (2006.01)

(52) U.S. Cl. ..... 2/144

(58) Field of Classification Search ..... 2/144–151, 2/152.1, 153–157; 24/49.1, 66.11; D2/605
See application file for complete search history.

(56) References Cited

U.S. PATENT DOCUMENTS

| | | | | | |
|---|---|---|---|---|---|
| 2,523,130 | A | * | 9/1950 | Manfred | 2/144 |
| 2,679,050 | A | * | 5/1954 | Dzus | 2/146 |
| 2,918,678 | A | * | 12/1959 | Gouner | 2/144 |
| 3,950,790 | A | | 4/1976 | Adler | |
| 3,953,894 | A | * | 5/1976 | Aron | 2/146 |
| 4,368,544 | A | | 1/1983 | Smith | |
| 5,016,285 | A | * | 5/1991 | Just | 2/144 |
| D346,270 | S | * | 4/1994 | Just | D2/608 |
| 5,463,779 | A | | 11/1995 | Pinkus | |
| 5,722,095 | A | | 3/1998 | Jonas | |
| 5,815,835 | A | * | 10/1998 | Craddock | 2/144 |
| 5,963,987 | A | | 10/1999 | Walls | |
| 6,550,650 | B2 | | 4/2003 | Fortier | |
| 7,322,049 | B1 | * | 1/2008 | Kennedy, Jr. | 2/144 |
| 2003/0226189 | A1 | | 12/2003 | Galante | |

* cited by examiner

*Primary Examiner*—Tejesh Patel
(74) *Attorney, Agent, or Firm*—Albert Bordas, P.A.

(57) ABSTRACT

Three-dimensional neckties have an outer layer with decorative ensembles attached to the outer layer, the decorative ensembles including additional decorative fabric pieces and other articles or trim pieces, and border stitching or embroidery stitching. The decorative fabric pieces of the decorative ensemble are attached to the outer layer only at certain points or areas so that at least a portion of the additional pieces are loosely positioned over the outer layer to accentuate the three-dimensional appearance of the necktie. In some embodiments, the decorative fabric pieces are attached to the outer layer by border stitching around an entire perimeter of the decorative fabric pieces, leaving the remainder loosely positioned over the outer layer. Trim pieces may include lace, string, hardware or other non-fabric items which are attached to the outer layer and which can be positioned over the decorative fabric pieces on the outer layer.

11 Claims, 13 Drawing Sheets

THREE-DIMENSIONAL NECK TIES

RELATED APPLICATIONS

This application is related to U.S. Provisional patent application No. 60/561,798, filed Apr. 14, 2004.

FIELD OF THE INVENTION

The present invention is in the general field of textiles and garments and, more particularly, in the field of dress garments with different types of combined decorative fabrics.

BACKGROUND OF THE INVENTION

Neckties are commonly constructed with an outer facing decorative fabric, such as silk or polyester, which is wrapped around an underlayment, interlining or foundation fabric. The foundation fabric provides body, shape and form to the outer layer, and contributes to the overall weight and draping characteristics of a necktie. U.S. Pat. Nos. 4,229,834 and 5,463,779 describe different types of interlining constructions for neckties. The outer decorative layer of material, which may be lined in some areas such as with silk or acetate, is wrapped around the interlining and secured by stitching at the back. In conventional neckties, the outer layer is the only decorative element or aspect. The outer layer is thus decorated with a printed or stitched design.

The main focus in necktie design is of course on the appearance of the decorative outer layer, with respect to the quality and type of the fabric and its graphic and textual designs. Silk is a preferred material both for its tying and draping characteristics, and for its adaptability to screen printing processes which enable application of detailed graphic patterns. Silk is also easily sewn, particularly in automation, which allows for complex stitch patterns and speeds mass production.

In some neckties decorative patterns or designs are sewn into the outer layer by hand or machine. To create designs with variation in color and texture, threads of different color and size are used to form lines and patterns, some of which may be raised from the outer layer of fabric as a result of multiple overlying stitches, i.e. raised stitching. This sewing technique can be used to create a raised or textured feel and appearance, which is visually distinct from flat screen-printed patterns. Because most neckties are produced using either screen-printing or automated sewing, the designs of the outer layers are largely limited to these two mediums. Although the design possibilities of these are many, they are ultimately limited particularly in the area of texturing and fabric variation.

Existing necktie designs are predicated on mass production wherein fabric processing including cutting, printing or dyeing, and sewing is all automated. This includes substantial decorative overstitching on the main outer layer material done by machine to create design patterns and raised stitch areas or lines. Other designs have been proposed wherein one or more pieces of material are combined to form the outer decorative layer, such as described in U.S. Pat. No. 3,950,790, wherein the facing fabric of a necktie is made up of multiple discrete pieces which are edge-sewn together to provide contrasting patterns and colors visible in different positions on the necktie as it is tied and worn. One of the two fabrics may alternately serve as a liner for the other fabric.

U.S. Pat. No. 5,722,095 describes neckties with irregular perimeters which are cut from fabric which has been printed or otherwise decorated or adorned with graphic features. The different appearance of neckties of this type is achieved by the cutting of the fabric to form non-linear or fanciful perimeters to the main portion or front of the necktie, and the printing processes used.

U.S. Pat. No. 5,963,987 describes a necktie with a front face constructed of a variety of fabrics configured in various structural patterns including braiding and pleats in the specific arrangements shown. This patent does not provide any disclosure of how the pieces of material are sewn together, nor does it describe multiple discrete pieces of material or layers of material and other decorative pieces which are combined together in an ensemble which is attached to a front face of a necktie to create a three-dimensional appearance to the necktie.

SUMMARY OF THE INVENTION

The present invention improves upon these limitations of the materials and construction of prior art neckties, and provides novel neckties with new and different constructions and appearances. In accordance with one general aspect of the invention, there is provided a necktie which has a foundational material, an outer layer of material which serves as a decorative outer layer, and one or more additional pieces of decorative material which are sewn or otherwise attached over the decorative outer layer to create a three-dimensional necktie with unique structural and aesthetic characteristics. The additional pieces of decorative material may be differentiated from the outer layer by material type, color and/or texture. Sewn attachment of the additional pieces may be done by stitching with color coordinated thread, or by thread patterns which create additional color and dimension along with the outer layer and additional pieces. The additional pieces may be fixedly attached to the outer layer, such as for example by attachment of the entire perimeter, or loosely attached such that part or all of an additional piece freely overlies the outer layer. The manner of attachment of the additional pieces to the outer layer adds to the three-dimensional characteristics of the neckties of the invention.

In accordance with another general aspect of the invention, there is provided a necktie of novel three-dimensional construction achieved by overlapping attachment of multiple layers of decorative and internal fabric, which includes: a foundational layer of material which serves to define the form of the necktie; an outer layer which is formed around the foundational layer and which serves as the decorative outwardly facing material of the tie and as an underlying layer for additional pieces of decorative material which are fixedly or loosely attached to overlying the outer layer by either inconspicuous or decorative sewn attachment.

In accordance with another general aspect of the invention, there is provided a novel three-dimensional necktie which has a decorative outer layer and one or more additional pieces of decorative material which are attached to the outer layer by decorative stitching or lace or string lace which forms a defining border between the additional pieces and the outer layer. The appearance of the necktie is three-dimensional because the additional pieces overlie the outer layer, and the colors, designs and fabric type of the outer layer and additional pieces can be differentiated.

In accordance with still another aspect of the invention, a three-dimensional necktie has an interlining, an outer decorative layer which substantially covers the interlining, and a decorative ensemble layer made of a plurality of interconnected decorative elements which may include additional pieces of fabric, stitching, lace, string, beads, buttons or other articles. The decorative ensemble is secured to a front face portion of the outer layer of the necktie.

These and other aspects of the present invention are described herein with reference to the accompanying Figures which are representative of some of the ways in which the principles and concepts of the invention can be executed.

DETAILED DESCRIPTION OF PREFERRED AND ALTERNATE EMBODIMENTS

Figure 1:
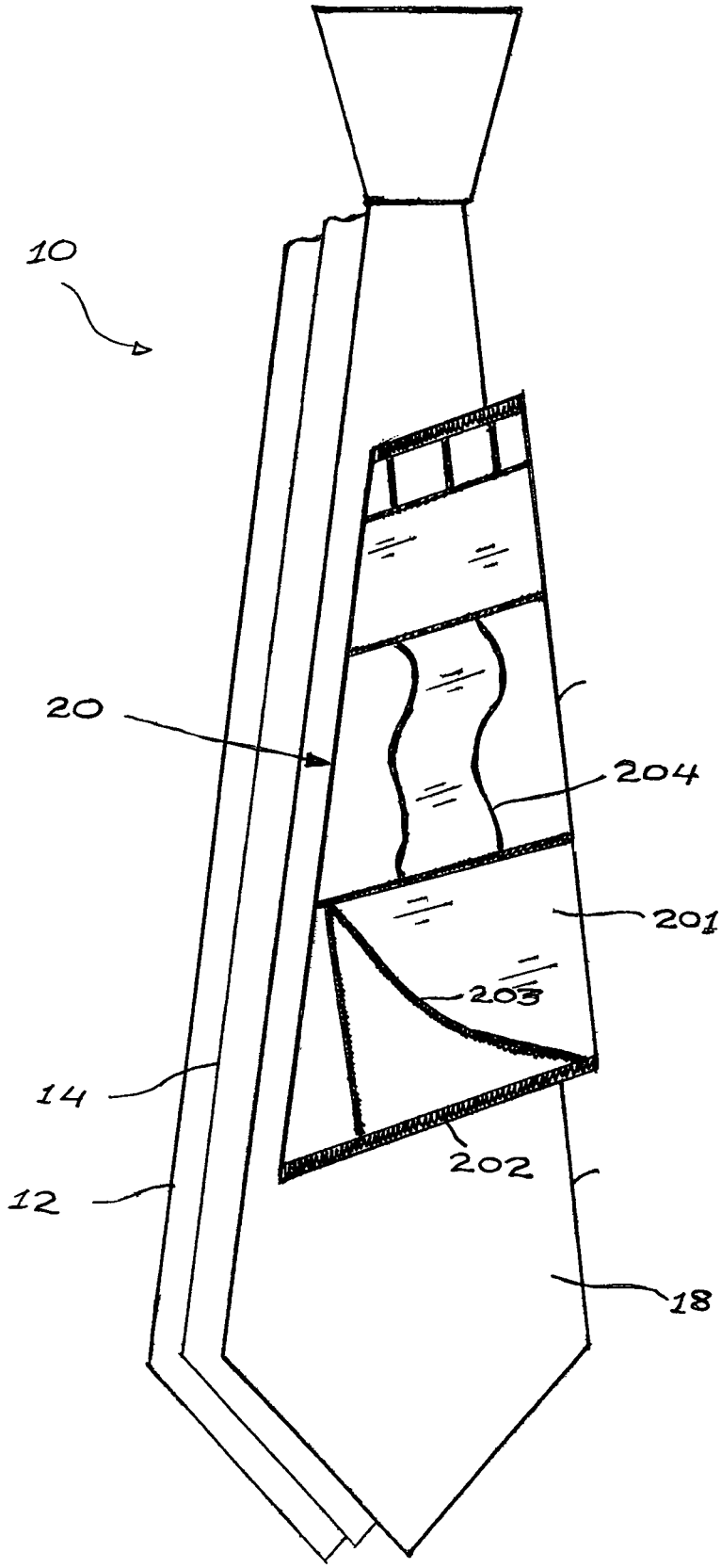
FIG. 1 is a perspective assembly view of a three-dimensional necktie constructed in accordance with the present invention.

With reference to FIG. 1, there is illustrated a three-dimensional necktie generally indicated at 10. The necktie 10 of this particular embodiment has four basic structural components including, an interlining 12, a lining 14 (also referred to as an "intermediate lining"), a decorative outer layer 18, and one or more decorative pieces, referred to collectively at 20 and also as a "decorative ensemble", as further described. The interlining 12 is made of one or more plies of a woven material of suitable weight, warp and weave to provide appropriate flexibility, softness and drape to the necktie. The intermediate lining 14 can be very light weight and low friction material such as nylon or acetate, and be color coordinated with the rest of the necktie as at least a portion of the lining is exposed. The decorative outer layer 18 is the primary or underlying decorative fabric of the necktie, and is therefore made of silk or wool or colored or printed nylon or other material which is attractive by itself and/or is further embellished or embroidered to create additional color and design features to the outer layer. For example, the outer layer 18 may be a single piece of material of a solid color or printed with a pattern, and with or without stitching on any color or design. Top stitching on the outer layer 18 may form raised features such as ridges or borders around color-differentiated areas, or fill in entire sub-areas with thread of different types or colors, or in other words design features which are sewn into the fabric of the outer layer 18. As known in the necktie art, a portion of the outer layer forms a frontal face of the necktie, defined by four linear edges and the knot, when worn in the tied configuration, as illustrated in the Figures.

The decorative piece or pieces 20, i.e. decorative ensemble 20, may be made of multiple decorative fabric pieces 201 of fabric or other textiles or objects (also referred to herein as "individual pieces" or "additional pieces"). The individual fabric pieces may be the same or different than the material of the outer layer 18, and attached directly or indirectly to the outer facing surface of the outer layer 18. Individual fabric pieces 201 may include border stitching 202 or embroidered stitching 203 in any shape or design or colors. Lace may be used in place of or on top of border stitching 202 or embroider stitching 203. Trim pieces 204, such as lace, string, piping or other objects, including non-fabric objects such as buttons, beads or hardware as further described are attached by stitching to the additional pieces 201 or extend from the additional pieces 201 for attachment either to the outer layer 18 or to another additional piece 201 of material, as shown. Also, the lace or trim pieces 204 or even individual fabric pieces 201 may extend from the front facing panel of the outer layer 18 around to the back opposing surface of the outer layer at the perimeter of the necktie so as to appear continuous and not terminate at an edge of the necktie.

In this manner there may be multiple additional pieces 201 which are interconnected directly, or indirectly by attachment with an intermediate piece 201 and/or lace or string or piping trim pieces 204, i.e. "decorative pieces". In some embodiments the decorative pieces 204 are items made of materials other than fabric, such as hardware, buttons, beads, etc. The entire integrated assembly of the decorative pieces, i.e., the decorative ensemble 20, is secured to the outer layer 18 by stitching or adhesive. A particular feature of the invention is that one or more of the decorative fabric pieces 201 of the decorative ensemble 20 is superimposed over the outer layer 18, lying above and spaced from the outer layer 18, so that the necktie has a multi-dimensional appearance wherein the decorative fabric pieces 201 stand apart from the outer layer 18. The decorative ensemble 20 and described components thereof may or may not be coordinated either structurally or aesthetically with the fabric or design of the frontal face of the outer layer 18.

Figure 2:
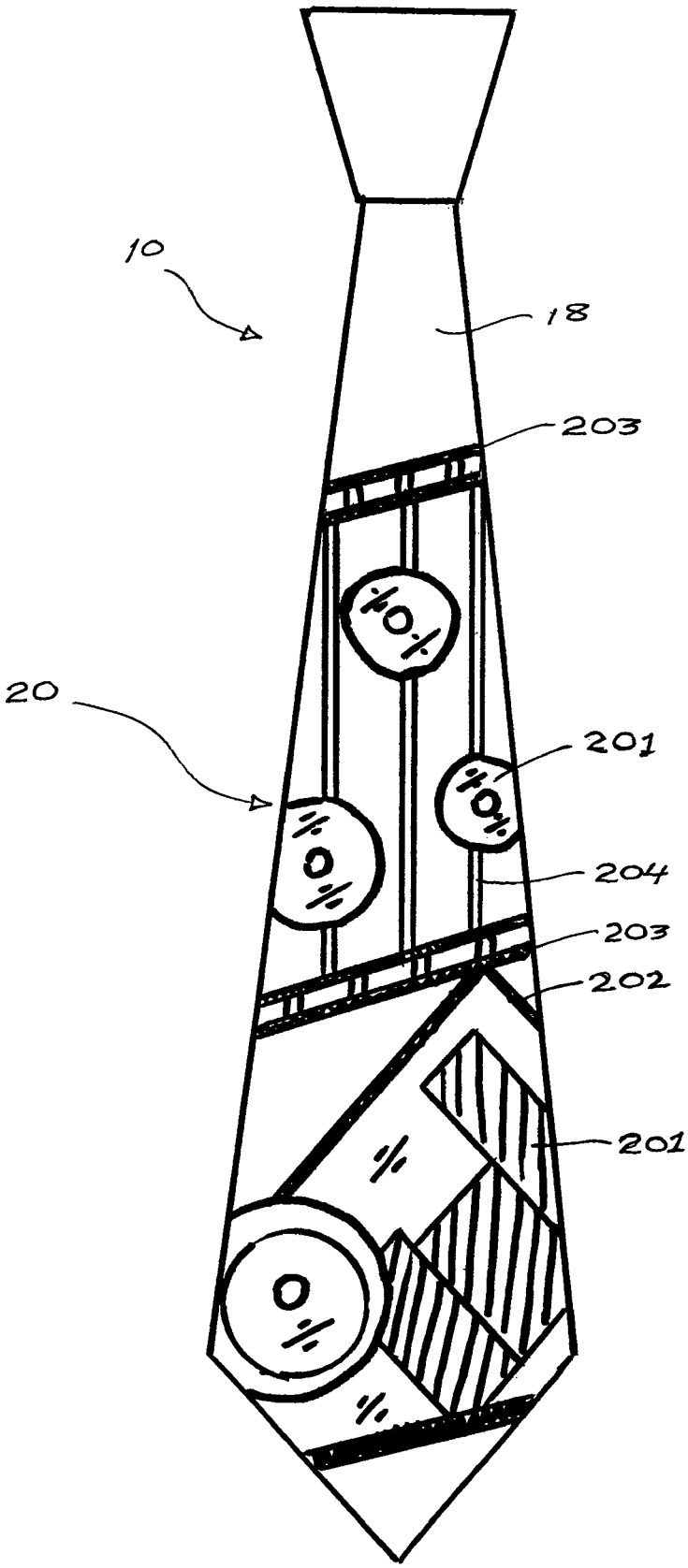
FIGS. 2-13 are frontal views of various alternate embodiments of three-dimensional neckties constructed in accordance with the present invention.

FIG. 2 illustrates an alternate embodiment of a three-dimensional necktie indicated generally at 10 with a more elaborate decorative ensemble 20 which is made up of multiple decorative fabric pieces 201 of different fabrics, material and designs, which are interconnected by sewn attachment with stitching and border stitching 202, embroidering 203 and lace, string or piping trim pieces 204.

Figure 3:
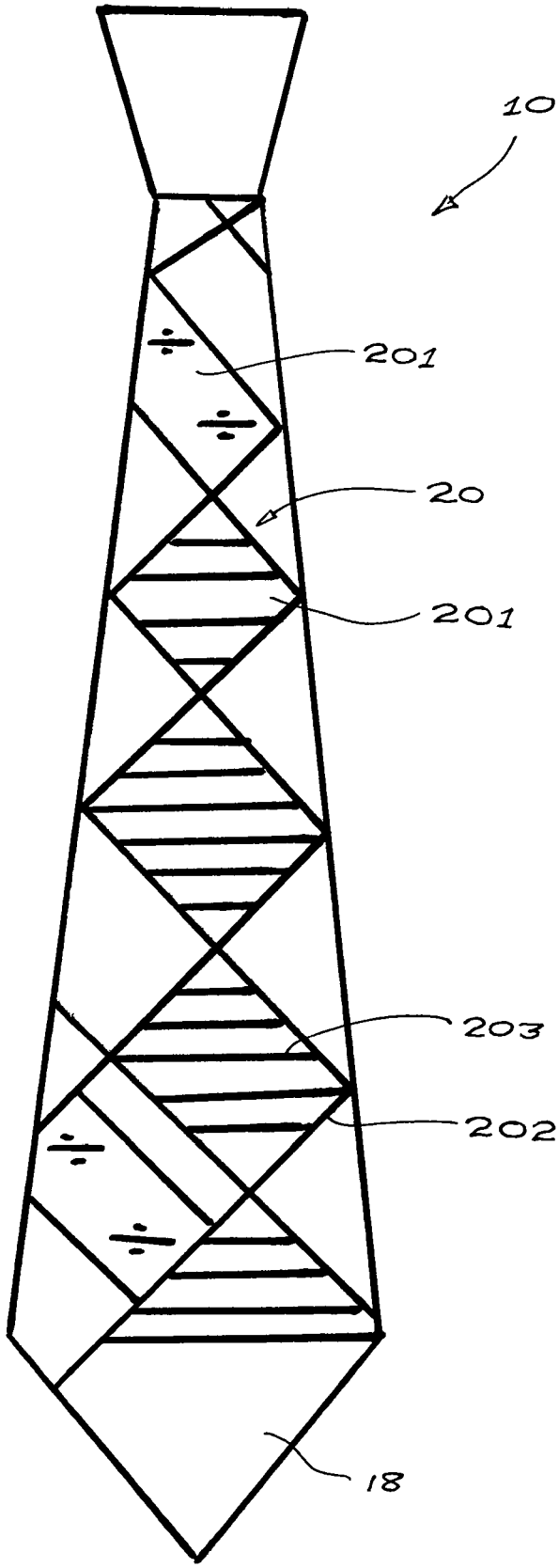

FIG. 3 illustrates an alternate embodiment of a three-dimensional necktie indicated generally at 10, which has a repeated pattern defined by the decorative ensemble 20 which overlies the outer layer 18. Each of the decorative fabric pieces 201 are bordered by border stitching 202 and also have embroidering 203 or other stitching or decoration thereon. Trim pieces 204 in the form of lace or piping or cord can be used in place of or over the stitching 202 or 203.

Figure 4:
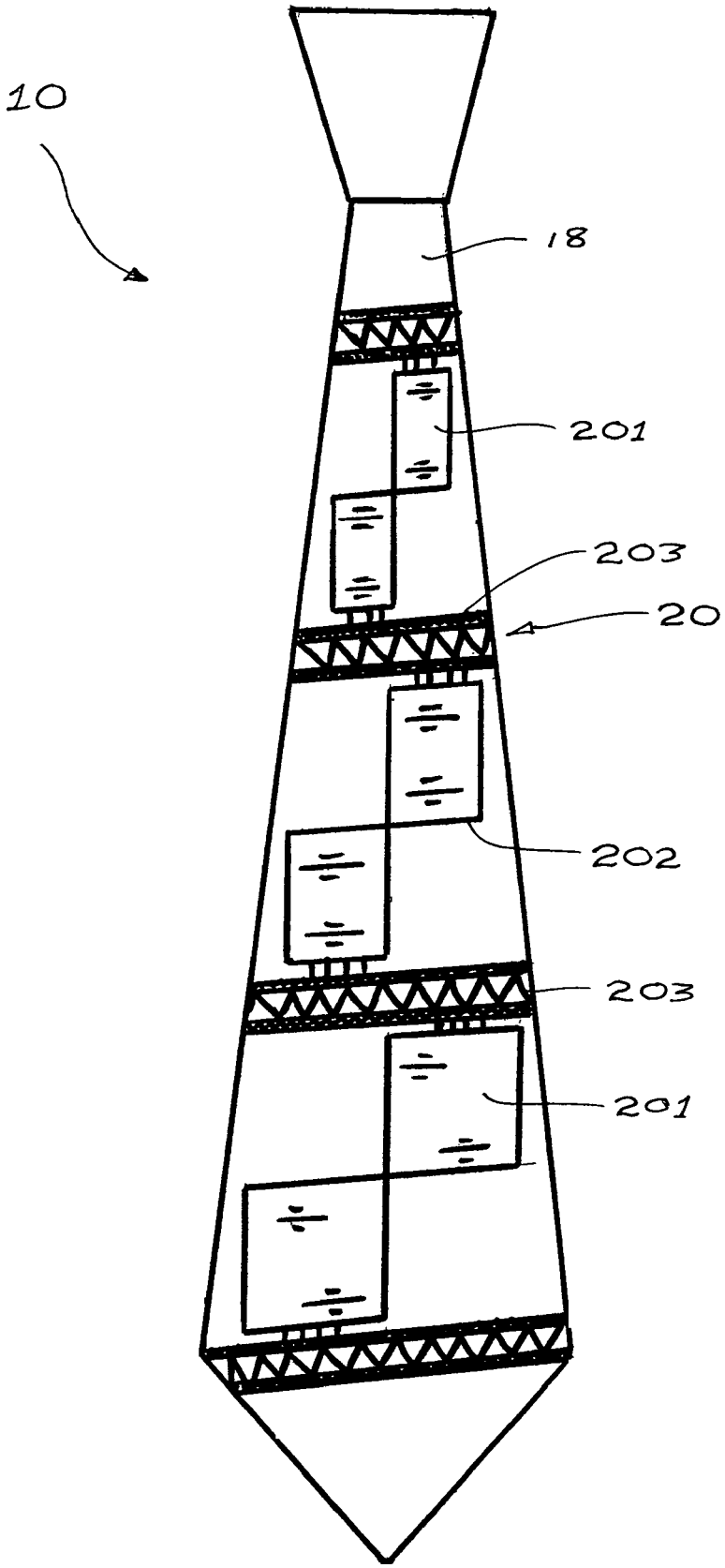

FIG. 4 illustrates an alternate embodiment of a three-dimensional necktie of the invention, indicated generally at 10, which includes an overall decorative ensemble 20 made up of a repeating pattern of decorative fabric pieces 201 of fabric which is distinct from the underlying outer layer 18. Each of the decorative fabric pieces 201 have border stitching 202 and are attached only indirectly to the outer layer 18 by trim pieces 204 which extend from the decorative fabric pieces 201 to intermediate trim pieces 204 which are secured to the outer layer 18. In this manner the decorative fabric pieces 201 are disposed to float freely over the outer layer for a three-dimensional and unattached appearance, wherein the individual pieces are positioned over but not attached to the outer layer 18.

Figure 5:
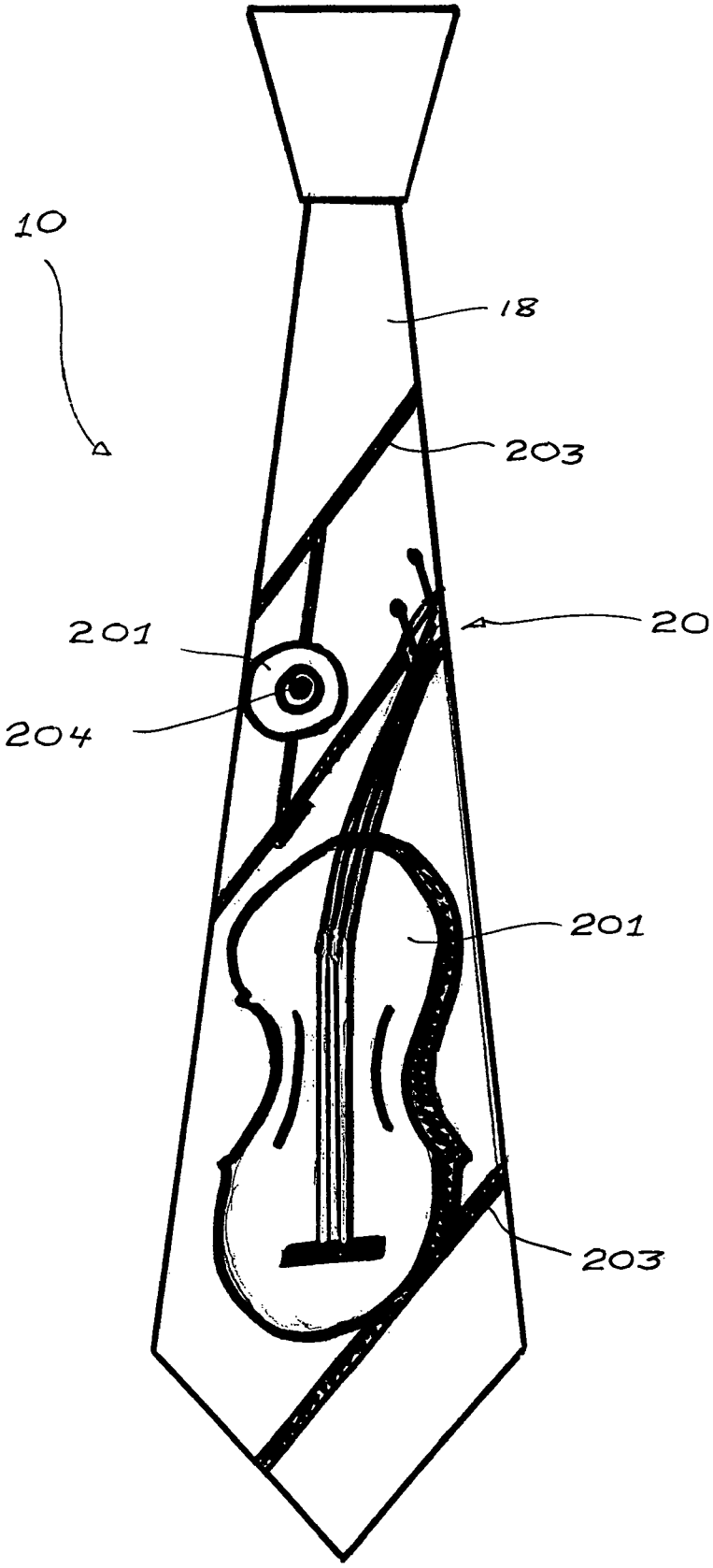

FIG. 5 illustrates another alternate embodiment of a three-dimensional necktie of the invention wherein the decorative ensemble 20 which overlies the outer layer 18 is made up of additional fabric pieces 201, which may be in the form of recognizable shapes such as in this case a violin. Border stitching 202 and embroider stitching 203 are used to further accentuate the form of the additional piece 201, which is not attached directly to the outer layer 18, but rather by attachment to trim pieces 204. A second additional piece 201 such as the circular object is positioned above the violin-shaped additional piece 201, and also loosely overlies the outer layer 18 by attachment only to adjacent trim pieces 204.

Figure 6:
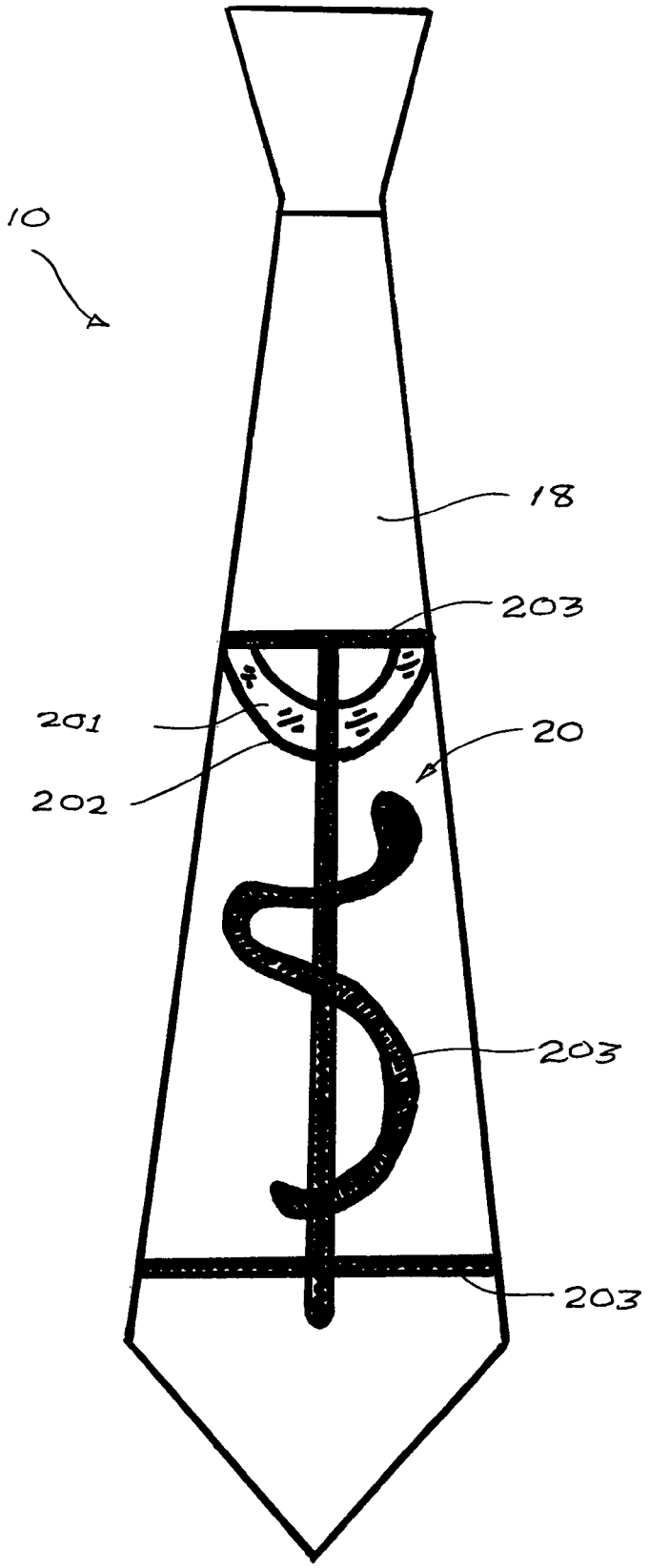

FIG. 6 illustrates still another alternate embodiment of a three-dimensional necktie of the invention wherein a decorative ensemble 20 is formed and attached to the outer layer by embroider stitching 203 and/or trim pieces 204, and relatively small decorative fabric pieces 201 of fabric which loosely overlie the outer layer 18. In this particular embodiment a larger percentage of the decorative ensemble 20 as a whole can be directly attached to the outer layer, but the individual pieces 201 still loosely overlie the outer layer 18 by attachment only at the interface with stitching 203 or trim pieces 204.

Figure 7:
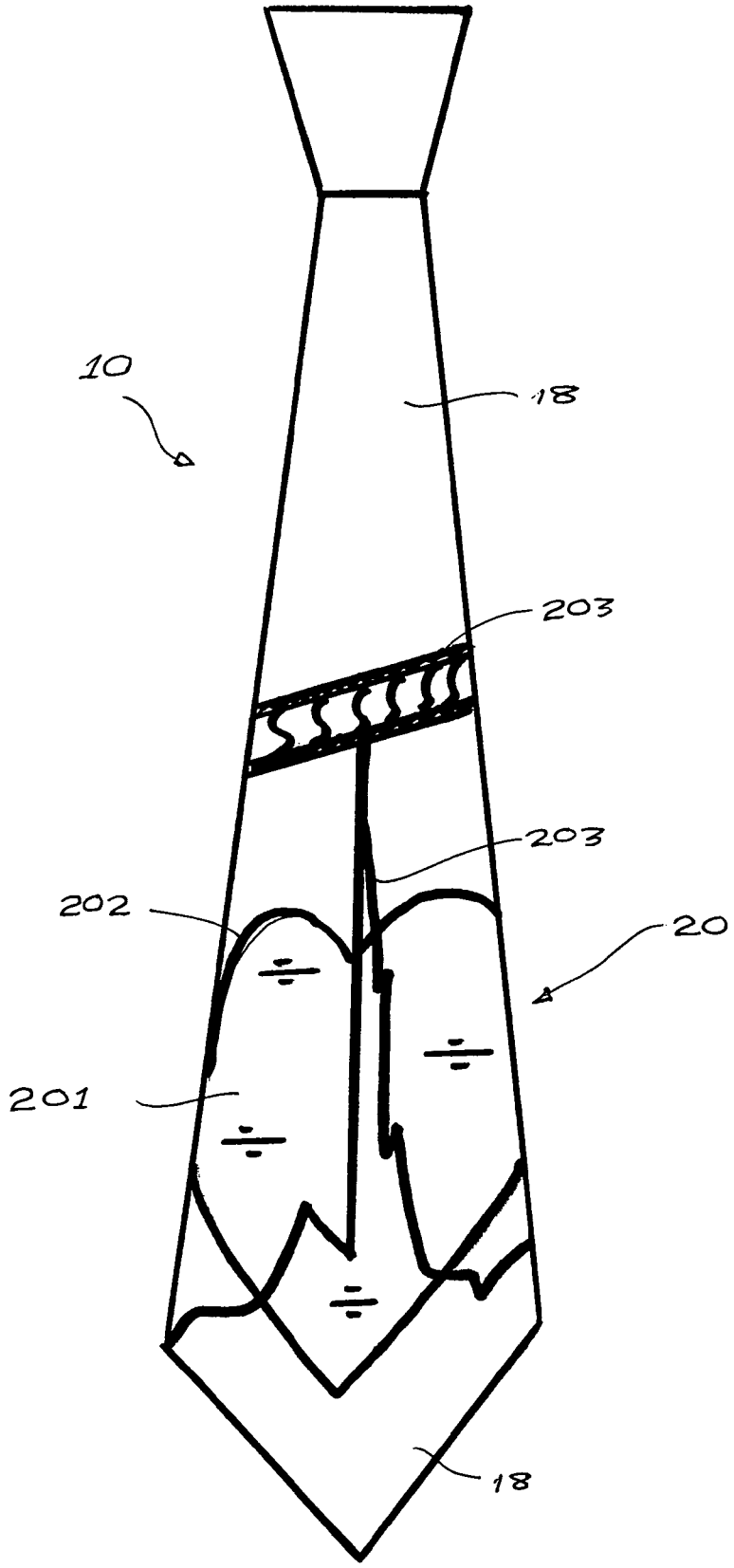

FIG. 7 illustrates another alternate embodiment of a three-dimensional necktie of the invention, indicated generally at 10, wherein a decorative ensemble, indicated generally at 20, includes a single individual piece 201 of fabric, in a distinctive shape or configuration such as a heart as shown, which is attached to overlie, the outer layer 18 of the necktie 10. Although the individual fabric piece 201 is shown with border stitching 202, the piece 201 may or may not be secured to the outer layer about its complete perimeter. For example, attachment at only some points about the perimeter is possible and contributes to a three-dimensional appearance. Also, the perimeter of the individual piece 201 can extend around the side edge 181 of the outer layer 18 as shown. Embroidery stitching 203 can be used to form an additional design element, such as a representation of a heart rhythm, over the individual piece 201. Alternatively, a trim piece such as lace, piping, cord, garland or string can be used to create the form of the desired design and secured to the outer layer 18 and/or individual piece 201. One or more additional trim pieces 204 can also be included in the decorative ensemble 20, such as decorative lace, as shown and attached to the outer layer 18.

Figure 8:
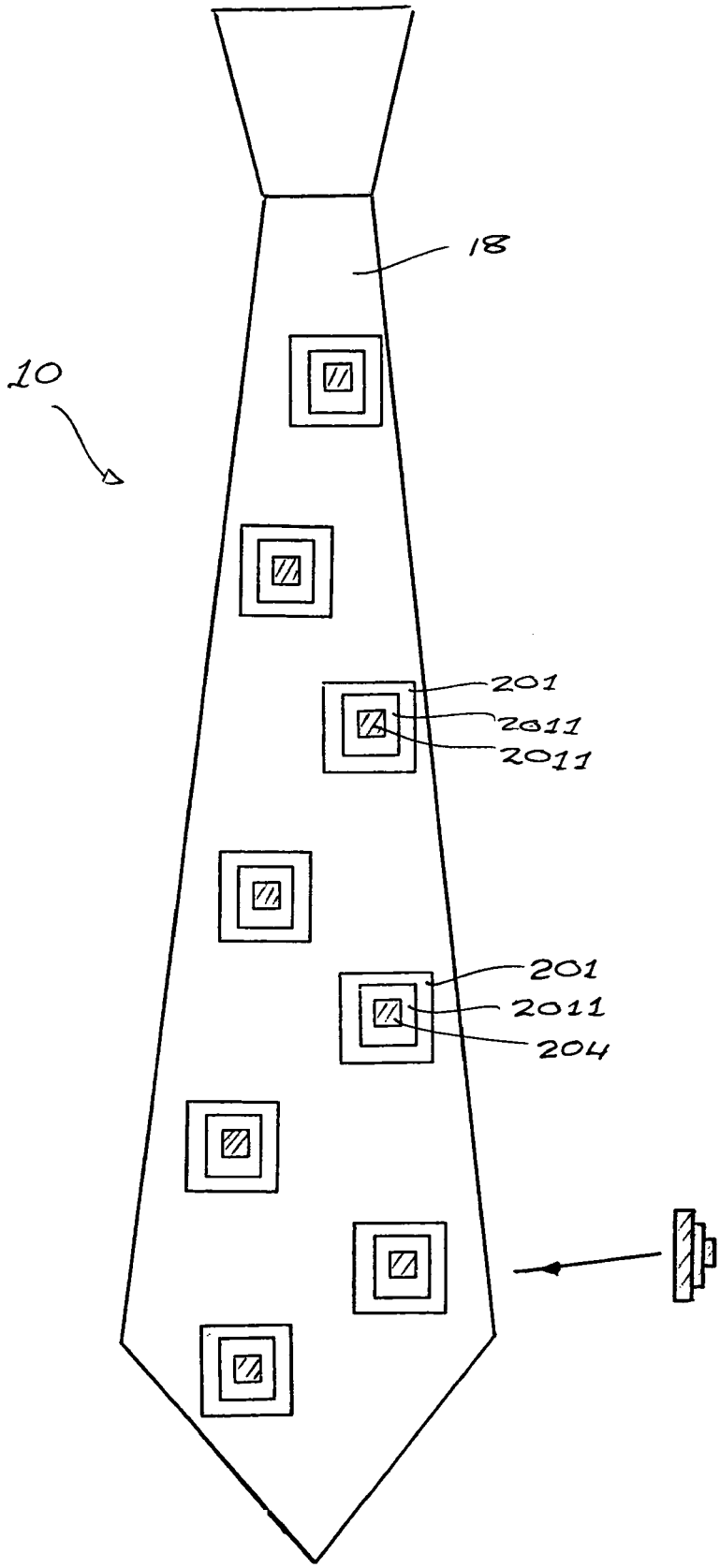

FIG. 8 illustrates a further alternate embodiment of a three dimensional necktie of the present invention, indicated generally at 10, wherein multiple decorative fabric pieces 201 are discreetly attached to the outer layer 18 to collectively make up a decorative ensemble 20. Each of the decorative fabric pieces 201 further include additional pieces 2011 and/or trim pieces 204 whereby each individual piece is three-dimensional by itself, that is, rising above the outer layer 18. This multi-layered three-dimensional construction is visually distinct from the raised effect of embroidery or overstitching as can be achieved through automated sewing operations.

Figure 9:
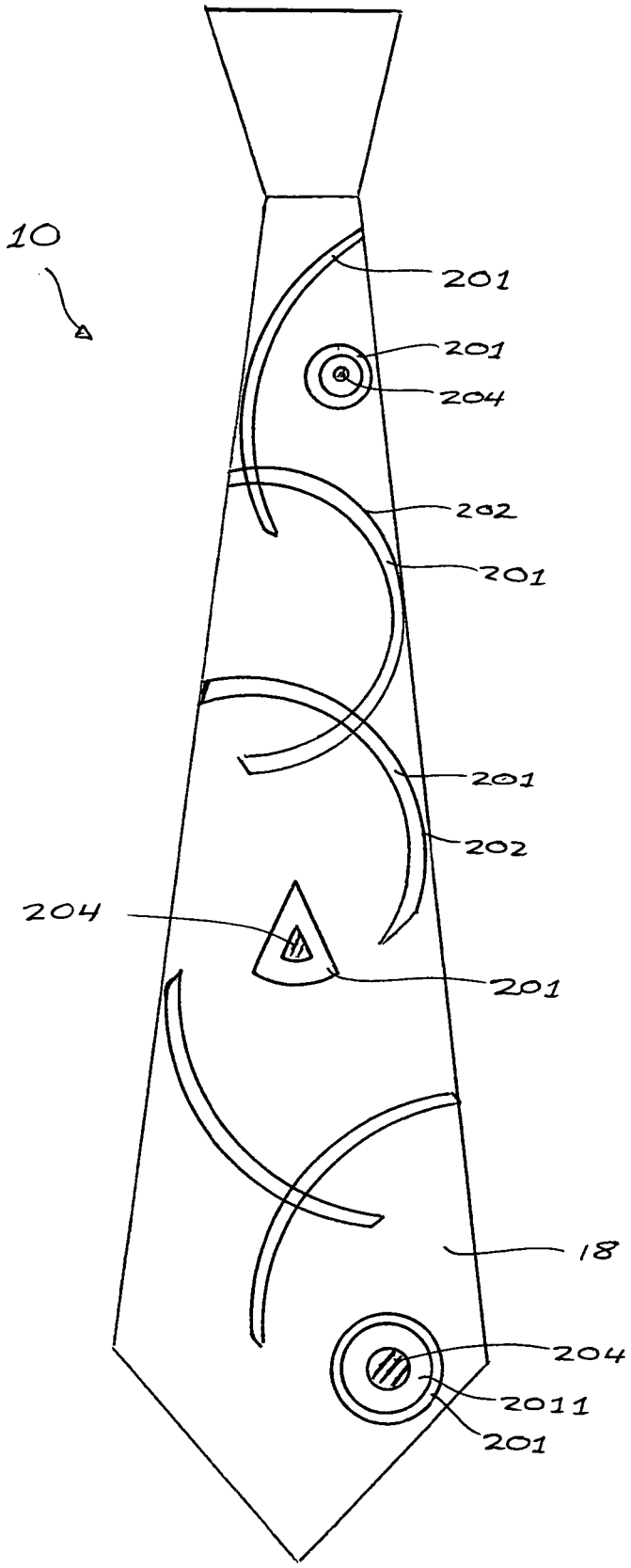

FIG. 9 illustrates an alternate embodiment of a three-dimensional necktie of the invention, indicated generally at 10, wherein multiple decorative fabric pieces 201 are somewhat randomly arranged upon the outer layer 18, and further including trim pieces 204 for example of non-fabric variety in combination with embroidery stitching 203. Where decorative fabric pieces 201 of fabric material are used it is preferred that they be attached only at discreet points so that at least a portion of each individual piece 201 floats above the outer layer for an enhanced three-dimensional appearance.

Figure 10:
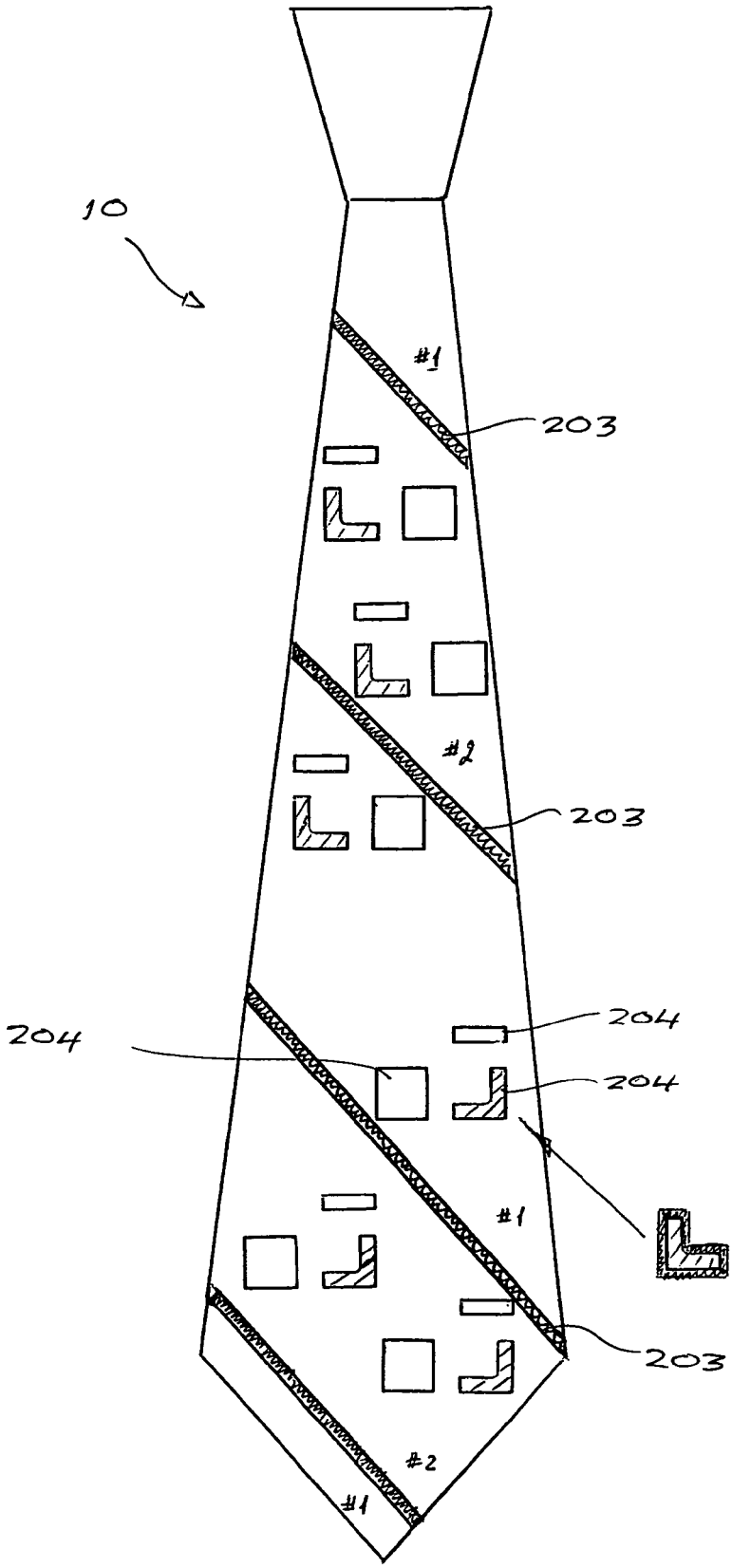

FIG. 10 illustrates an alternate embodiment of a three-dimensional necktie of the invention, indicated generally at 10, which includes multiple design regions defined by decorative fabric pieces 201 of fabric overlying the outer layer 18, with trim pieces 203 defining boundaries of the regions, and further with smaller additional pieces 2011 and/or trim pieces 204 located on the underlying additional pieces 201. As previously noted, the additional pieces 201 and 2011 can be of different materials and graphic patterns to define the overall appearance of the necktie.

Figure 11:
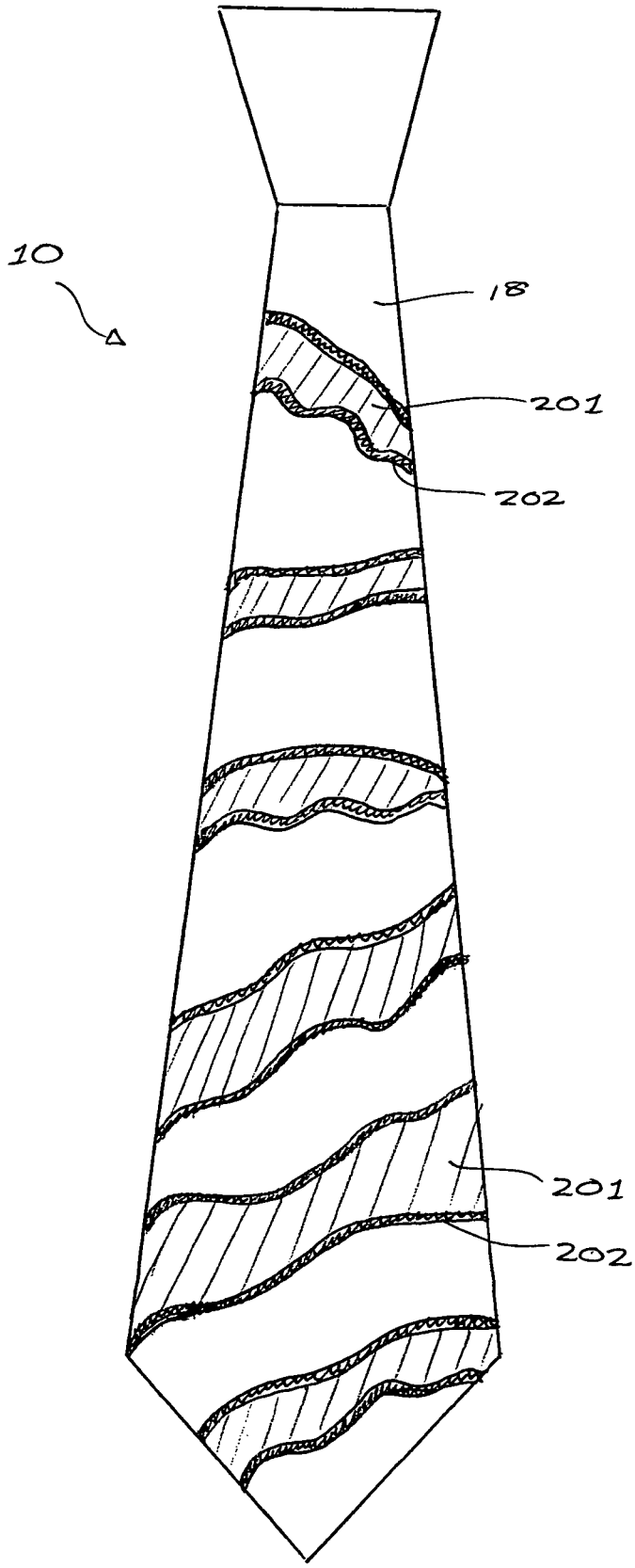

FIG. 11 illustrates an alternate embodiment of a three-dimensional necktie of the invention, indicated generally at 10, which has multiple decorative fabric pieces 201 overlying the outer layer 18, spaced from each other, and in random shapes which do not follow the triangular shape or outline of the facing surface of the outer layer 18. Further, the decorative fabric pieces 201 can be wrapped around the perimeter edge of the outer layer 18 as shown. The generally non-linear edges of the decorative fabric pieces 201 can be adorned with border stitching 202 which extends into the outer layer or by lace or other trim 203.

Figure 12:
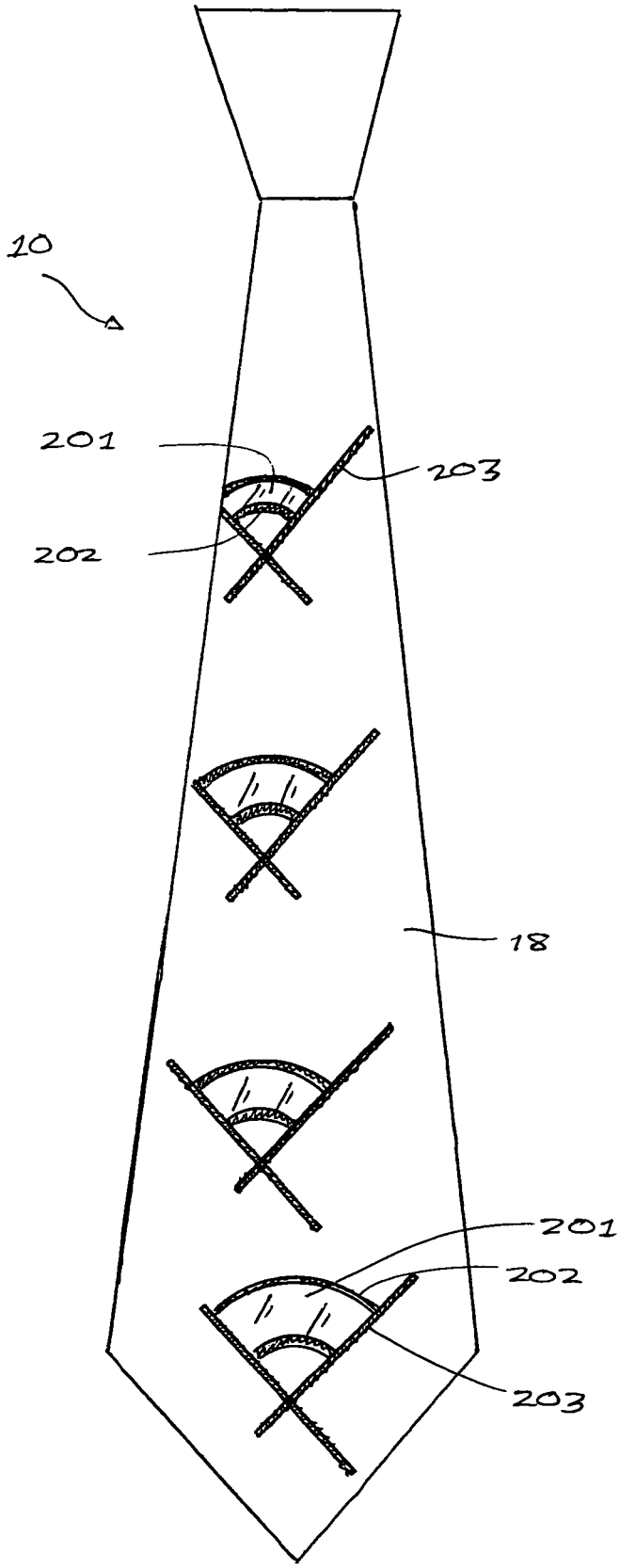

FIG. 12 illustrates a still further embodiment of a three-dimensional necktie of the invention, indicated generally at 10, with a repeating pattern of design elements which include both additional pieces 201 which are not directly attached to the outer layer, but which are substantially encircled by border stitching 202 or embroidery 203. With this embodiment also the loose attachment of the additional pieces 201 of fabric contributes to the three-dimensional appearance of the necktie because the additional pieces are not rigidly secured or directly sewn into the outer layer 18.

Figure 13:
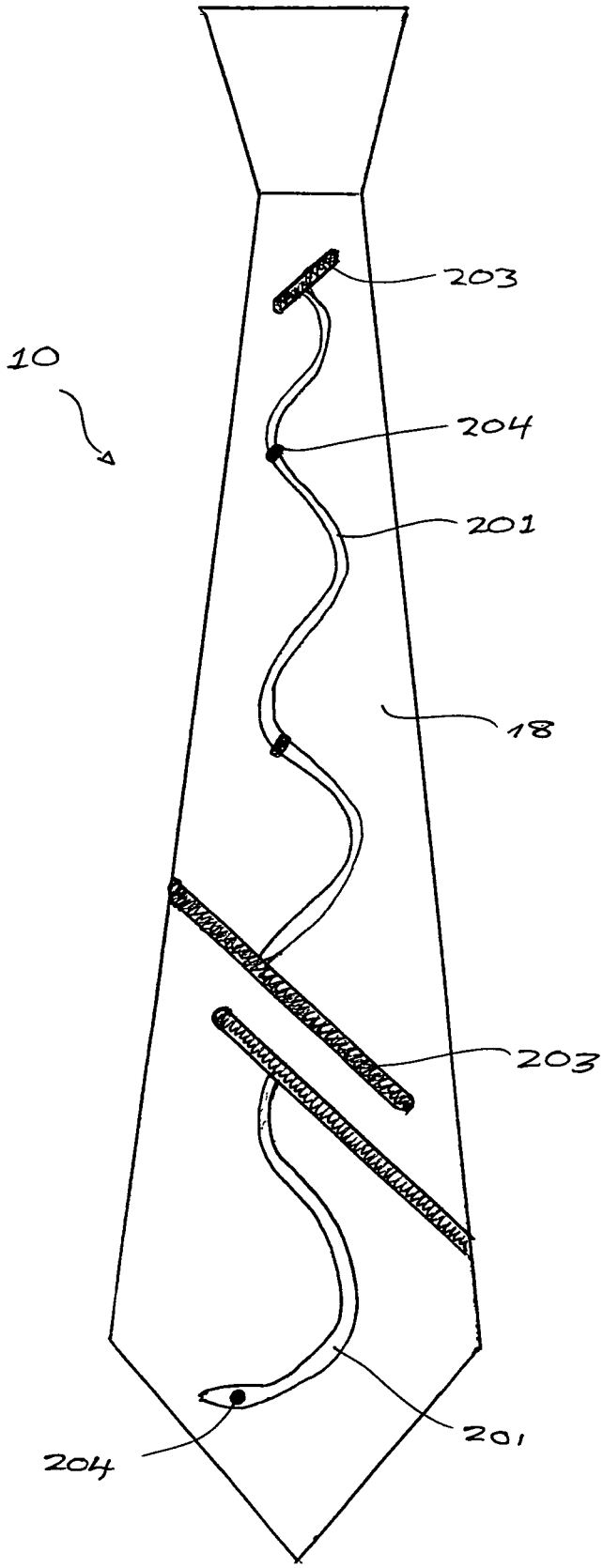

And FIG. 13 illustrates yet another alternate embodiment of a three-dimensional necktie indicated generally at 10 which has a serpentine shaped individual piece or pieces 201 of fabric attached at selected points to the outer layer and intersecting with one or more trim pieces 204 and embroidery stitching 203. The embroidery stitching may extend to edges of the front face of the outer layer 18 as shown.

In the described alternate embodiments wherein the individual pieces 201 of fabric, the accompanying border trim 202, embroidery 204 and trim pieces 204 are spread about the frontal face of the outer layer with spaces therebetween, they nonetheless make up the referenced decorative ensemble 20 as a whole without physical connection between the pieces.

These examples of alternate embodiments of three-dimensional neckties of the invention illustrate the principles and concepts of the invention but are not limiting to the number or variations of ways in which the principles and concepts of the invention can be carried out.

What is claimed as the invention is:

1. A three-dimensional necktie, consisting of:

A) at least one interlining;

B) at least one outer layer integrally disposed about the at least one interlining, the at least one outer layer having an internal lining integrally disposed between the at least one interlining and the at least one outer layer, a portion of the at least one outer layer defining a frontal face of a necktie; and C) at least one decorative ensemble of similar or dissimilar shapes located entirely within a perimeter of the frontal face of the at least one outer layer, the at least one decorative ensemble consisting of at least one decorative fabric piece positioned over and integrally and permanently attached to the at least one outer layer only at edges of the at least one decorative fabric piece or at points to the frontal face whereby an expanse of the at least one decorative fabric piece between the edges or the points is raised above said at least one outer layer and is not attached to the at least one outer layer, the at least one decorative fabric piece is of a supplementary material than that of said at least one outer layer, and said at least one decorative fabric piece does not lie flat against the at least one outer layer.

2. The three-dimensional necktie of claim 1, further characterized in that the at least one decorative fabric piece extends around an edge of the frontal face.

3. The three-dimensional necktie of claim 1, further characterized in that the at least one decorative fabric piece has edges which are not aligned with edges of the frontal face.

4. The three-dimensional necktie of claim 1, further characterized in that the at least one decorative ensemble comprises two or more decorative fabric pieces which are arranged contiguously on the frontal face.

5. The three-dimensional necktie of claim 1, further comprising at least one item of decorative trim positioned over said at least one outer layer and integrally and permanently attached to said at least one outer layer at edges of said at least one item of decorative trim or at points to said frontal face of said at least one outer layer whereby an expanse of said at least one item of decorative trim is not attached to said at least one outer layer, said at least one item of decorative trim is of a supplementary fabric or other than fabric material than that of said at least one outer layer, and said at least one item of decorative trim does not lie flat against said at least one outer layer.

6. The three-dimensional necktie of claim 1, further characterized in that the at least one decorative ensemble comprises at least two decorative fabric pieces overlying and integrally and permanently attached to one another or to said at least one outer layer.

7. The three-dimensional necktie of claim 1, further comprising at least two items of decorative trim, a first item of said at least two items of decorative trim is integrally and permanently attached to the at least one decorative ensemble by a second item of said at least two items of decorative trim.

8. The three-dimensional necktie of claim 1, further characterized in that the at least one decorative ensemble comprises multiple pieces of decorative fabric configured in a repeating pattern and wherein edges of the multiple pieces of decorative fabric are not aligned with edges of the frontal face.

9. The three-dimensional necktie of claim 1, further characterized in that a portion of the at least one decorative ensemble extends to an edge of the frontal face.

10. The three-dimensional necktie of claim 1, further comprising embroidery stitching which extends through the at least one item of decorative trim or the at least one decorative fabric piece.

11. The three-dimensional necktie of claim 1, further characterized in that at least one item of decorative trim is integrally and permanently attached to the at least one decorative fabric piece.

* * * * *